US008820384B2

(12) United States Patent
Boillot

(10) Patent No.: US 8,820,384 B2
(45) Date of Patent: Sep. 2, 2014

(54) ROLLER SHUTTER FOR AN OPENING IN A BUILDING

(75) Inventor: Benjamin Boillot, Saint-Ismier (FR)

(73) Assignee: Commissariat a l'energie Atomique et aux Energies Alternatives, Paris (FR)

( * ) Notice: Subject to any disclaimer, the term of this patent is extended or adjusted under 35 U.S.C. 154(b) by 0 days.

(21) Appl. No.: 13/880,807

(22) PCT Filed: Oct. 17, 2011

(86) PCT No.: PCT/EP2011/068137
§ 371 (c)(1),
(2), (4) Date: Jul. 16, 2013

(87) PCT Pub. No.: WO2012/052416
PCT Pub. Date: Apr. 26, 2012

(65) Prior Publication Data

US 2013/0284384 A1 Oct. 31, 2013

(30) Foreign Application Priority Data

Oct. 22, 2010 (FR) ..... 10 58696

(51) Int. Cl.
*E06B 9/08* (2006.01)

(52) U.S. Cl.
USPC ..... 160/98; 160/310; 160/242

(58) Field of Classification Search
CPC ..... E06B 9/40; E06B 9/24; E06B 9/42; E06B 2009/2452; E06B 9/68
USPC ..... 160/98, 310, 120
See application file for complete search history.

(56) References Cited

U.S. PATENT DOCUMENTS

| | | | | |
|---|---|---|---|---|
| 3,089,540 | A | 5/1963 | Leon | |
| 3,163,204 | A * | 12/1964 | Golde | 160/26 |
| 3,840,061 | A * | 10/1974 | Herms | 160/26 |
| 4,610,292 | A * | 9/1986 | Hausmann et al. | 160/120 |
| 4,679,406 | A * | 7/1987 | Weiblen | 62/262 |
| 5,353,152 | A * | 10/1994 | Realmuto | 359/461 |
| 7,093,643 | B2 * | 8/2006 | Ikle | 160/120 |
| 8,113,266 | B2 * | 2/2012 | Cloninger et al. | 160/310 |
| 2012/0291963 | A1 * | 11/2012 | Marocco | 160/120 |
| 2014/0027069 | A1 * | 1/2014 | Oppizzi | 160/6 |

FOREIGN PATENT DOCUMENTS

| | | | | |
|---|---|---|---|---|
| DE | 3227721 | A1 * | 3/1984 | E06B 9/20 |

* cited by examiner

*Primary Examiner* — Katherine Mitchell
*Assistant Examiner* — Johnnie A Shablack
(74) *Attorney, Agent, or Firm* — Occhiuti & Rohlicek LLP

(57) ABSTRACT

A roller shutter for an opening leaf of a building, includes a retractable shut-off panel that moves between retracted and deployed positions, and a guide to selectively guide the panel a path between the retracted position and a deployed position in a first plane, and another path is a path between the retracted position and a deployed position in a second plane parallel to said first plane. The guide selectively switches movement of between said first path and said second path. A deployment-switching stop guides the shut-off panel along the second path when the shut-off panel is in contact with the deployment switching stop and the shaft is driven in a direction of rotation for deployment.

15 Claims, 4 Drawing Sheets

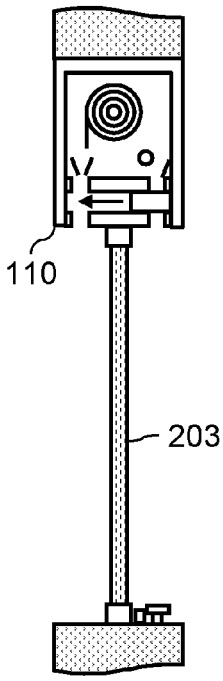
Fig. 9
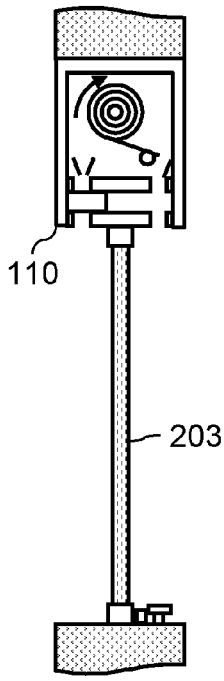
Fig. 10
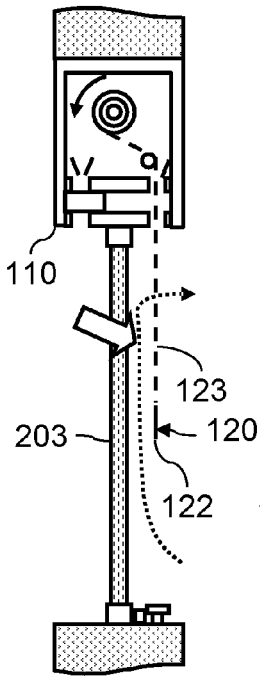
Fig. 11
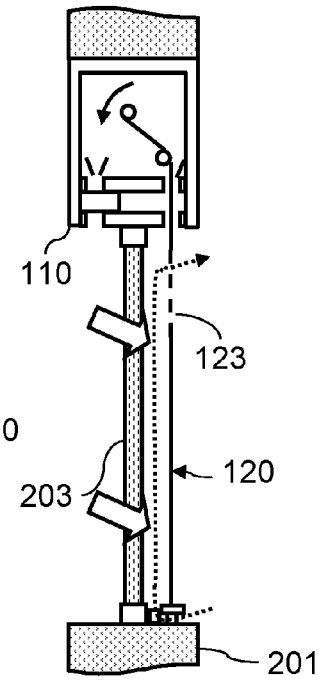
Fig. 12
Fig. 13
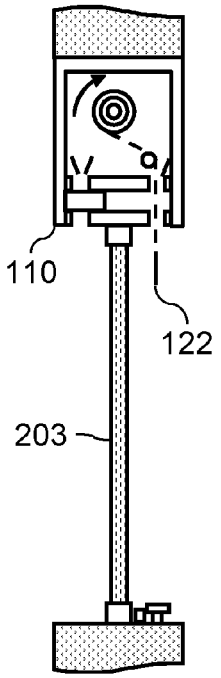
Fig. 14
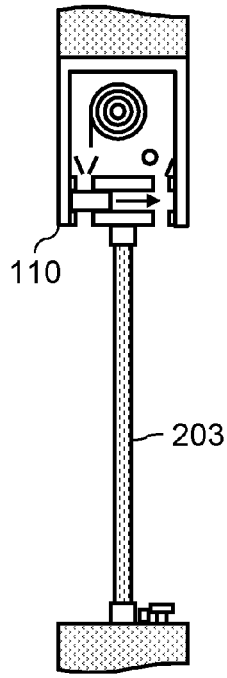
Fig. 15
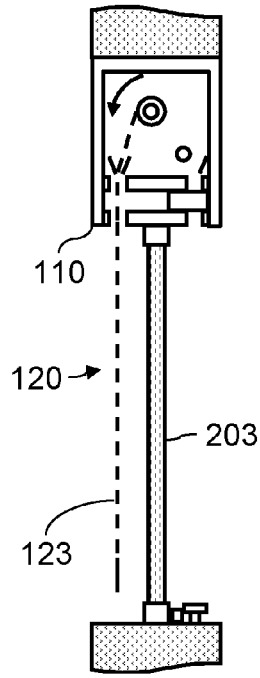

ROLLER SHUTTER FOR AN OPENING IN A BUILDING

RELATED APPLICATIONS

Under 35 USC 371, this is the national stage entry of PCT/EP2011/068137, filed on Oct. 17, 2011, which claims the benefit of the priority date of FR 1058696, filed on Oct. 22, 2010, the contents of which are incorporated herein by reference in their entirety.

FIELD OF INVENTION

The invention relates to roller shutters associated with opening leaves of buildings, such as doors or windows.

BACKGROUND

The use of external obturators attached to doors or windows is fairly widespread in the construction industry. An external shutter is positioned between an opening leaf and the outside environment. Obturators in the closed position thus make it possible to ensure thermal and sound insulation as well as a visual barrier through the opening leaf. The closed position of the shutter thus makes it possible to ensure privacy within the living space, to secure the building against intrusion (in particular on the ground floor), to limit heat exchanges in order avoid excessive heating in summer or heat losses in winter, to protect the opening leaf from severe weather or to limit the amount of light inside the living space. On the other hand, obturators in the open position allow sunlight to enter the living space. Among building accessories, obturators are prominent components which allow both the exchange of energy of the building with the outside and the visual or acoustic comfort achieved by the building to be managed dynamically.

A large number of obturators on the market take the form of roller shutters. Roller shutters comprise a collection of opaque slats linked one with another to form a shut-off panel in the closed position. The shut-off panel formed is then located on the outside of the opening leaf. The slats are rolled up around a shaft and are housed in an housing in the open position. The slats are selectively rolled up on a drum in order to open the obturator, or are unrolled from the drum in order to close the obturator. Driving the drum can be done from the inside either manually using a hand crank or electrically by means of a geared motor controlled by the user.

U.S. Pat. No. 3,089,540 describes a roller shutter comprising a shut-off panel driven in rotation by a shaft. The roller shutter is configured such that continuous rotation of the shaft in a same direction of rotation makes it possible successively to deploy the shut-off panel arranged in a first plane, then to retract it from this first plane. The panel can also be deployed in a second plane.

In particular in winter, the user of the roller shutters cannot reap the benefits of both optimum heating from outside light (by keeping the shut-off panel retracted) and at the same time increased privacy and security from intrusion (by keeping the shut-off panel deployed).

SUMMARY

The invention aims to provide a solution to this drawback. The invention thus relates to a roller shutter for an opening leaf of a building, comprising:

- a retractable shut-off panel, able to move between a retracted position and a deployed position;

- a drive device for driving the shut-off panel between the retracted position and the deployed position;
- a guidance device selectively guiding the shut-off panel along a first path between the retracted position and a deployed position in a first plane or along a second path between the retracted position and a deployed position in a second plane parallel to the first, the guidance device being configured to switch selectively the movement of the shut-off panel between the first path and the second path.

The roller shutter further comprises:

- a shaft driven in rotation about an axis by the drive device, the shut-off panel being rolled up around this shaft when in the retracted position, the shaft being configured to be driven selectively in a direction of rotation for retraction or in a direction of rotation for deployment of the shut-off panel, the directions of rotation for retraction and deployment being opposite to one another;
- a deployment switching stop, the shut-off panel being configured, when in the retracted position, to come into contact alternately with the deployment switching stop when the shaft rotates continuously in the direction of rotation for retraction, the deployment switching stop guiding the panel along the second path when the panel is in contact with the deployment switching stop and the shaft is driven in the direction of rotation for deployment, the panel being guided along the first path when the panel is not in contact with the deployment switching stop and the shaft is driven in the direction of rotation for deployment.

According to one variant, the shutter comprises a housing in which the shut-off panel is housed in the retracted position and from which the shut-off panel projects in said deployed positions, first and second openings being made in the housing in order to allow the shut-off panel to move respectively along the first and second paths, the roller shutter further comprising an isolation device shutting off the first opening when the panel is moved along the second path and shutting off the second opening when the panel is moved along the first path.

According to a further variant, the roller shutter comprises a brushing device housed in the housing and rubbing against the shut-off panel when the latter is moved along one of said paths.

According to another variant, the roller shutter comprises slide rails arranged vertically below the housing guiding the shut-off panel respectively along the first and second paths.

According to yet another variant, the shut-off panel is entirely retracted inside the housing in the retracted position.

According to one variant, the shut-off panel has one face which acts as a solar thermal collector.

According to a further variant, the panel comprises a plurality of slats which are articulated to each other about axes parallel to the axis of the shaft, the slats being connected to each other with travel and being configured to create openings between the slats when these are separated and to shut off these openings when the slats are brought close together.

According to another variant, the drive device comprises a geared motor configured to drive the shut-off panel selectively toward the retracted position or toward the deployed position and a control circuit for controlling the geared motor having a control interface accessible to a user for receiving a command to retract or deploy the panel.

According to yet another variant, the stop is arranged vertically below the panel when it is rolled up in the retracted position and is offset laterally relative to the axis of rotation of the shaft.

According to one variant, the panel is configured to be drawn by gravity toward contact with the stop.

The invention further relates to an opening leaf of a building, comprising:

a roller shutter as described hereinabove;

glazing for the opening leaf, arranged between said first and second planes.

According to one variant, the opening leaf comprises a roller shutter, the deployment switching stop being housed in the housing, and one end of the panel projecting from the rolled-up panel in the retracted position, a command on the control interface to switch from the first path to the second path causing a preparatory rotation of the shaft in the direction of rotation for retraction of the panel by the shaft until the end of the panel comes into contact with the switching stop, then a rotation of the shaft in the direction of rotation for deployment of the panel.

According to another variant, a lower opening connects the space between the glazing and the panel with the space behind the panel when the shut-off panel is in the deployed position in the second plane and an upper opening connects the space between the glazing and the panel with the space behind the panel when the shut-off panel is in the deployed position in the second plane.

According to a further variant, the opening leaf comprises a roller shutter comprising a end-of-travel stop below which the lower opening is made, the control circuit interrupting the travel of the panel in the second plane when one end of the panel comes into contact with the end-of-travel stop and when slats are still separated in the upper portion of the panel so as to form an upper opening.

The invention further relates to a method for controlling a roller shutter of an opening leaf of a building, comprising the steps of:

moving a retractable shut-off panel, by driving a shaft in rotation in a direction of rotation for retraction, from a deployed position in a first plane into a retracted position where the shut-off panel is rolled up around the shaft by guiding the panel along a first path;

rotating the shaft in the direction of rotation for retraction until the panel is brought into contact with a deployment switching stop;

when the panel is in contact with the deployment switching stop, moving the shut-off panel, by driving the shaft in rotation in a direction of rotation for deployment which is opposite to the direction of rotation for retraction, from the retracted position to a deployed position in a second plane parallel to the first by guiding the panel along a second path.

BRIEF DESCRIPTION OF THE FIGURES

Other features and advantages of the invention will become apparent from the description of the invention given hereinbelow, which is indicative and in no way limiting, in reference to the attached drawings, in which:

FIGS. 9 to 12 are views in section from the side of the roller shutter of FIG. 3 at various stages of deployment of a panel toward the inside of a building;

FIGS. 13 to 15 are views in section from the side of the roller shutter of FIG. 3 during switching of the panel from an inside configuration to an outside configuration;

DETAILED DESCRIPTION

The invention proposes controlling a roller shutter of an opening leaf of a building, the roller shutter comprising a retractable shut-off panel. The roller shutter is controlled by guiding the deployment of the shut-off panel selectively along a first path on the outside of the opening leaf and along a second path on the inside of the opening leaf. Each path of the panel is defined between a retracted position and a deployed position, the deployed positions being arranged in planes which are parallel to, and at a distance from, each other. The panel in the retracted position is rolled up around a shaft driven in rotation about an axis by the drive device, selectively in a direction of rotation for retraction or in a direction of rotation for deployment, these directions being opposite to one another. The roller shutter further comprises a deployment switching stop, the panel being configured, when in the retracted position, to come into contact alternately with the deployment switching stop and the shaft rotates continuously in the direction of rotation for retraction. The deployment switching stop guides the panel along the second path when the panel is in contact with the deployment switching stop and the shaft is driven in the direction of rotation for deployment. The panel is guided along the first path when the panel is not in contact with the deployment switching stop and the shaft is driven in the direction of rotation for deployment.

The invention makes it possible to have the traditional functions of a roller shutter, namely a selective visual barrier through the opening leaf, selective penetration of outside light, selective protection against forced entry, and selective heat transmission. Moreover, this roller shutter makes it possible to benefit from a greenhouse effect in a configuration where the panel is on the inside, making it possible to enjoy selectively an energy contribution from outside by converting sunlight into heat. A user of the roller shutter will thus be able to enjoy, at the same time, an energy contribution from outside in winter without having to make the building interior visible and without the security against intrusion being impaired.

Figure 1:
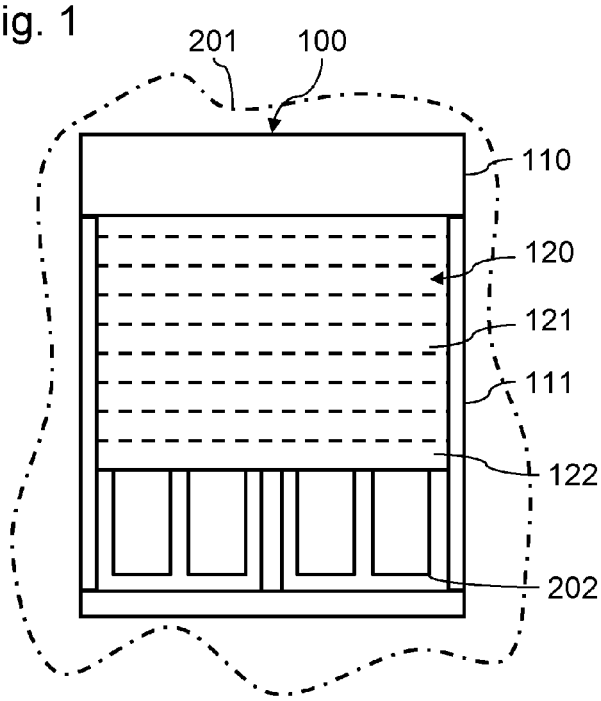
FIG. 1 is a front view of an opening leaf fitted with a roller shutter according to one embodiment of the invention.
Figure 2:
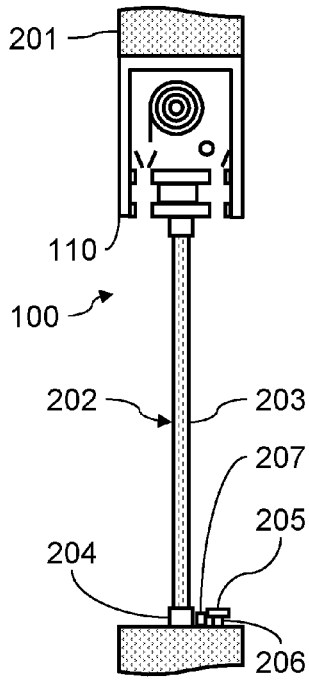
FIG. 2 is a view in section from the side of the opening leaf of FIG. 1.

FIG. 1 is a front view of an opening leaf of a building 202 fitted with a roller shutter 100 according to the invention. FIG. 2 is a view in section from the side of this same opening leaf 202. The opening leaf 202 is a glazed window arranged in an opening made in a wall 201 and providing access toward the interior of a building. The opening leaf 202 has glazing 203 mounted in a frame 204. Although the invention is illustrated in its application for a window, the invention of course applies to any other type of opening leaf of a building, such as a door or french doors.

The roller shutter 100 comprises a housing 110 arranged in the upper portion of the opening of the wall 201. The housing 110 is intended to house a retractable shut-off panel 120. The shut-off panel 120 comprises, in a manner known per se, opaque slats 121 which are articulated to each other. The shut-off panel 120 can be moved between a retracted position inside the housing 110 and a deployed position.

Figure 3:
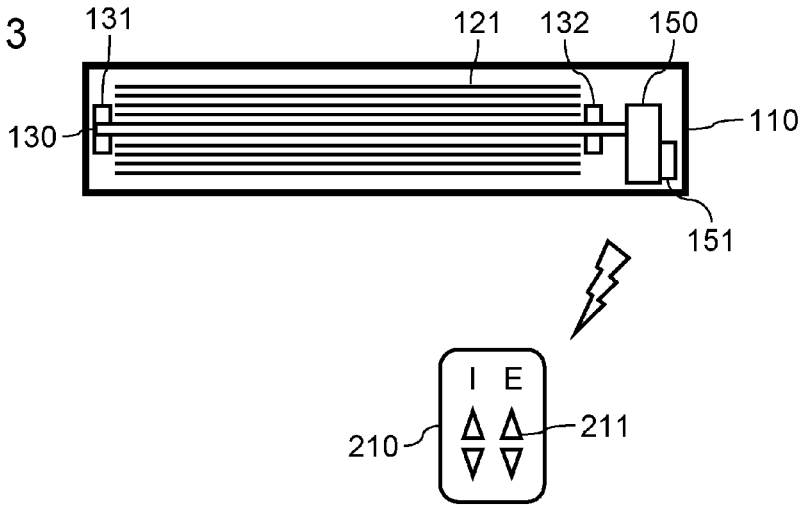
FIG. 3 is a view in section from above of the roller shutter shown in FIG. 1.

As shown in FIG. 3, the roller shutter 100 has a drive device for driving the shut-off panel 120 between the retracted position and the deployed position. The drive device comprises, in a manner known per se, a shaft 130. The shaft 130 extends in the transverse direction of the opening in the wall 201. The shaft 130 is mounted so as to rotate in bearings 131 and 132. The shaft 130 is designed to allow the panel 120 to be rolled up around it when this shaft 130 is driven in rotation. In the retracted position, the shut-off panel 120 is rolled up around the shaft 130. The slats 121 of the panel 120 are articulated to each other about axes parallel to the axis of the shaft 130 in order to allow them to be rolled up. The slats 121 are advantageously also connected to each other with travel in a manner known per se: the slats are configured to create openings 123 between them when they are subjected to a separation force, and configured to block off these openings 123 when these slats 121 are brought close together. The panel 120 has one lower end slat 122 which has a free edge.

The shaft 130 can be driven in rotation either in a direction of rotation for retraction of the panel 120 or in a direction of rotation for deployment of the panel 120. The shaft 130 is advantageously driven in rotation by means of a geared motor 150 controlled by a control circuit 151. The geared motor 150 and the control circuit 151 are housed inside the housing 110. The geared motor 150 makes it possible to drive the panel 120 selectively toward the retracted position or toward a deployed position as will be explained below. The control circuit 151 is advantageously associated with a remote control 210 or a wall-mounted switch box in order to form a control interface accessible to a user. The remote control 210 has, for example, buttons 211 by means of which the user can order a retraction or deployment of the panel 120, either on the inside or on the outside of the building.

The roller shutter 100 comprises a guidance device for selectively guiding the shut-off panel 120 along a first path between the retracted position and a deployed position in a first, outside, plane, or along a second path between the retracted position and a deployed position in a second, inside, plane. The deployment positions of the panel 120 are located on either side of the glazing 203 which separates the inside from the outside. The first plane and the second plane are parallel to, and at a distance from, each other. The guidance device is configured to switch selectively the movement of the shut-off panel 120 between the first path and the second path. The shut-off panel 120 can thus advantageously be deployed either on the inside or on the outside of the building.

The guidance device advantageously comprises two pairs of slide rails 111, arranged vertically below the housing 110 and guiding the shut-off panel 120 respectively along the first and second paths. To this end, the slide rails 111 hold the lateral edges of the panel 120 in order to allow the shut-off panel 120 to be deployed in said first and second planes.

The roller shutter 100 comprises an end-of-travel stop 205 arranged behind the window 202. The end-of-travel stop 205 makes it possible to define the lower sliding position of the panel 120 in the second plane. The end slat 122 is thus designed to come into contact with the end-of-travel stop 205 when the panel 120 is fully deployed inside the building. The end-of-travel stop 205 can be fitted with a sensor making it possible to detect contact between said stop and the end slat 122 in order for the circuit 151 to manage the automated system. The end-of-travel stop 205 might be realized in the form of a bar extending transversely in the lower portion of the opening created in the wall 201.

The roller shutter 100 is advantageously mounted in the opening of the wall 201 so as to form a lower opening which connects the space between the glazing 203 and the panel 120 with the space behind the panel when the panel 120 is in the deployed position in the second plane. In the example shown, the lower opening is obtained by creating a vertical space 206 between the wall 201 and the stop 205, and by creating a horizontal space 207 between this stop 205 and the frame 204 of the opening leaf 202.

Figure 4:
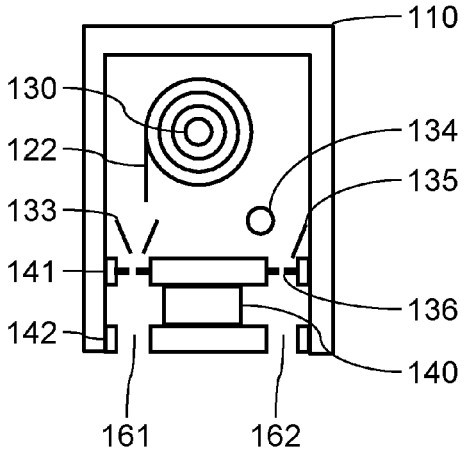
FIG. 4 is an enlarged view in section of the interior in a housing of the roller shutter of FIG. 3.

The view in section of the interior of the housing 110 in FIG. 4 shows additional details of the guidance device according to this embodiment. The housing 110 comprises lower panels 141 and 142. The panels 141 and 142 each comprise a first opening 161 arranged in vertical alignment with said first plane. The opening 161 thus allows the shut-off panel 120 to slide out from the housing 110 in the first plane. The panels 141 and 142 each comprise a second opening 162 arranged in vertical alignment with the second plane. The opening 162 thus allows the shut-off panel 120 to slide out from the housing 110 in the second plane.

The guidance device advantageously comprises a guidance channel 133. The guidance channel 133 is arranged in vertical alignment above the openings 161. The guidance channel 133 also has a cross section which converges toward the openings 161 so as to receive the lower end slat 122 of the panel 120 and convey it accurately toward the openings 162 when this panel 120 moves from its retracted position to its deployed position in the first plane. The guidance device further comprises a stop 134 which allows the deployment of the panel 120 to be switched, as will be explained below. The stop 134 is advantageously arranged lower down than the shaft 130 and than the rolled up panel 120. The stop 134 is advantageously arranged in vertical alignment with the rolled up panel 120 in the retracted position and is advantageously offset laterally relative to the axis of rotation of the shaft 130. The stop 134 advantageously takes the form of a transverse shaft (the cross section of which can be non-circular) arranged substantially in vertical alignment with the openings 162. A guidance plate 135 is arranged further inside the building relative to the stop 134, and substantially in vertical alignment with the openings 162. The guidance plate 135 is inclined in order to be able to guide the panel 120 toward the openings 162 when this panel 120 is in contact against the stop 134.

It is possible to use, either in place of or in addition to the guidance channel 133, external slide rails 111 the upper opening of which is widened so as to receive the end slat 122 and then convey it to the middle portion of the slide rails 111 while it slides. It is possible to use, either in place of or in addition to the stop 134, internal slide rails 111 the upper opening of which is widened so as to receive the end slat 122 and then convey it to the middle portion of the slide rails 111 while it slides.

In order to avoid the housing 110 causing any undesirable heat exchanges between the interior and the exterior, the roller shutter 100 advantageously comprises a thermal insulation device which selectively shuts off an opening 161 or an opening 162, depending on the position of the shut-off panel 120. The shut-off device shown comprises a movable shutter 140 mounted so as to slide between the panels 141 and 142. The shutter 140 is driven by a motor means (not shown) controlled by the control circuit 151. The shutter 140 can slide toward a first position in which it shuts off the openings 161 and thus prevents air from flowing from outside the building toward the interior of the housing 110. In this first position, it allows the panel 120 to pass through the openings 162. The shutter 140 can also slide toward a second position in which it shuts off the openings 162 and thus prevents air from flowing from inside the building toward the interior of the housing 110. In this second position, it allows the panel 120 to pass through the openings 161.

Figure 5:
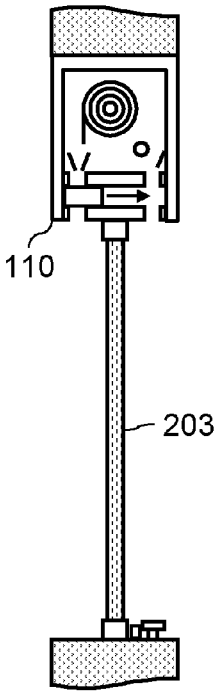
FIGS. 5 to 8 are views in section from the side of the roller shutter of FIG. 3 at various stages of deployment of a panel toward the outside of a building.
Figure 6:
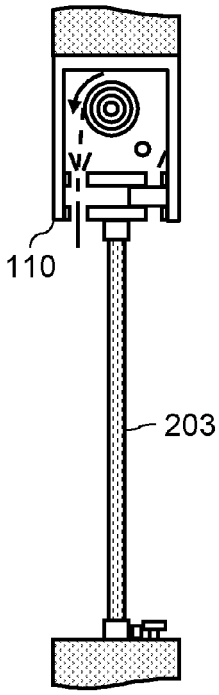
Figure 7:
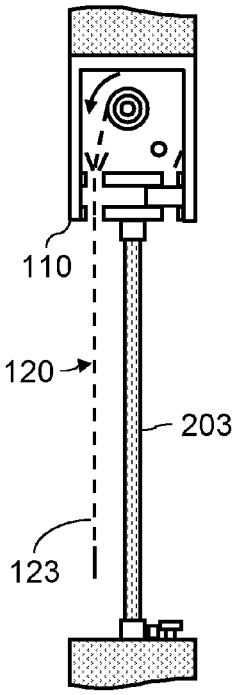
Figure 8:
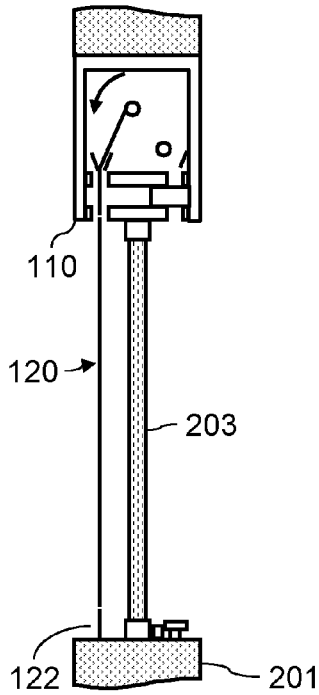

FIGS. 5 to 8 show the deployment of the panel 120 from its retracted position into an outside deployed position completely shutting off the window 202. FIG. 5 shows the roller shutter 100 in the retracted position inside the housing 110. In this position, the panel 120 does not interfere with the transmission of light through the glazing 203 and has no effect on the heat exchanges between the inside and the outside of the building. The roller shutter 100 receives a command to deploy the panel 120 toward the outside. The shutter 140, initially shutting off the openings 161, is moved so as to free up these openings and shut off the openings 162. The directions of rotation of the shaft 130 are described for the views in section shown. As shown in FIG. 6, the shaft 130 is driven in rotation in a counterclockwise direction (direction of deployment) by the geared motor 150. The end slat 122 positions itself in the channel 133 in order to be guided in vertical alignment with the openings 161. The end slat 122 then passes through the openings 161 and begins to slide in the first plane, located on the outside of the building. In FIG. 7, the shaft 130 continues to rotate in a counterclockwise direction. The panel 120 is then in an intermediate deployment position. This intermediate deployment position can advantageously be maintained by the control circuit 151. In this position, the panel 120 partly blocks the transmission of light through the glazing 203. In this position, the panel 120 thus provides a measure of privacy inside the building, avoids excessive light levels inside the building and provides a degree of protection from intrusion. The building interior nevertheless enjoys a certain amount of outside light through the openings 123 and through the opening created underneath the end slat 122. In FIG. 8, the shaft 130 continues to rotate in the counterclockwise direction until the panel 120 is entirely deployed in the first plane. In this position, the end slat 122 is in abutment against the wall 201. The slats 121 are then brought close together and are joined up so that the openings 123 are shut off. Thus, transmission of light energy through the glazing 203 is avoided and the heat exchanges between the outside and the inside of the building are minimal (the glazing 203 acts as a thermal insulator behind the panel 120). The opening leaf 202 can be opened while enjoying the protection of the panel 120 against intrusions.

FIGS. 9 to 12 illustrate the deployment of the panel 120 from its retracted position to an inferior deployed position shutting off the window 202. FIG. 9 shows the roller shutter 100 in the retracted position inside the housing 110. The roller shutter 100 receives a command to deploy the panel 120 on the inside. The shutter 140, initially shutting off the openings 162, is moved so as to free up these openings and shut off the openings 161. As shown in FIG. 10, the shaft 130 is driven in rotation in a clockwise direction (direction for retraction) by the geared motor 150. The panel 120 is configured such that, as the shaft 130 continues to be driven in rotation in a clockwise direction (direction for retraction), this panel comes into contact with the switching stop 134. Were the shaft 130 to be continuously driven in rotation in the clockwise direction, the panel 120 would alternately come into contact with the stop 134. The panel 120 is in this case advantageously configured so as to be drawn by terrestrial gravity toward contact with the stop 134. The rotation is continued until the end slat 122 comes into contact against the deployment switching stop 134. The stop 134 holds the end slat 122 in vertical alignment with the openings 162. As shown in FIG. 11, the shaft 130 is then driven in rotation in a counterclockwise direction by the geared motor 150. The end slat 122, possibly guided by the guidance plate 135, passes through the openings 162. The driving of the shaft 130 in the counterclockwise direction is continued until the intermediate deployment position shown in FIG. 11 is reached. In this position, the interior of the building enjoys a greenhouse effect between the glazing 203 and the panel 120. The air between the panel 120 and the glazing 203 is heated by sunlight. Moreover, due to the openings 123 and the space below the end slat 122, heating this air generates a flow of air as shown by the dotted arrow. This flow of air allows the heat recovered to be spread inside the building. This intermediate deployment position makes it possible to take advantage of light coming from outside. Intermediate deployment is particularly advantageous in winter when the angle of incidence makes sunlight more dazzling. This proves to be particularly advantageous for large south-facing opening leaves in bioclimatic living spaces. This intermediate deployment position can advantageously be maintained by the control circuit 151. In FIG. 12, the rotation of the shaft 130 in the counterclockwise direction is continued until the panel 120 is entirely deployed in the second plane.

Deployment of the panel 120 in the second plane (i.e. inside the building) can prove to be particularly advantageous, notably in winter. Thus, the building can benefit from a heat contribution while at the same time enjoying increased protection from intrusions and privacy with respect to the outside.

Advantageously, the control circuit 151 interrupts the rotation of the shaft 130 when the panel 120 reaches the deployed position shown in FIG. 12. In this position, the lower slats 121 are joined up while the upper slats 121 are separated so as to reveal their openings 123. The revealed openings 123 thus create an upper opening of the panel 120. Thus, even in this fully deployed position, it is possible to enjoy a flow of heated air inside the building, the flow passing through the openings 206, 207, through the air space between the panel 120 and the glazing 203, and through the openings 123.

FIGS. 13 to 15 show the operation of the roller shutter 100 when a user orders the panel 120 to be switched from inside to outside. The panel 120 is retracted beforehand by a clockwise rotation of the shaft 130. Once the panel 120 is rolled up around the shaft 130 inside the housing 110, the shutter 140 is moved from its position shutting off the openings 161 toward its position shutting off the openings 162. The panel 120 is then deployed on the outside through the openings 161 by means of a counterclockwise rotation of the shaft 130.

Furthermore, in order to optimize the greenhouse effect and the recuperation of thermal energy when the panel 120 is deployed in the second plane on the inside of the building, this panel 120 advantageously has one face which acts as a solar thermal collector in this configuration. A solar thermal collector converts light energy into heat. A solar thermal collector can in particular be realized by means of a specific coating applied to this face of the panel 120. A solar thermal collector can also be realized by an appropriate choice of the material from which the slats 121 are made, for example a metal treated to have a dark-colored surface.

The roller shutter 100 advantageously comprises a brushing device 136 housed in the housing 110. The brushing device 136 is configured to rub against the shut-off panel 120 when the latter is moved along the first path or along the second path. A brushing device 136 proves to be particularly advantageous since one and the same shut-off panel 120 can selectively be brought from outside the building toward the inside, with dirt potentially having been deposited on the slats 121. The brushing device 136 avoids the building interior becoming dirty in this way. The brushing device 136 in this case comprises brushes extending from the panel 141 level with the openings 161 and 162. Brushes can also be arranged at any appropriate location, for example advantageously only at the openings 161, in order to keep the dirt removed from the slats 121 outside the housing 110.

When the panel 120 is retracted, it is advantageously housed entirely inside the housing 110, with no stop preventing the end slat 122 from entering the housing 110.

Figure 16:
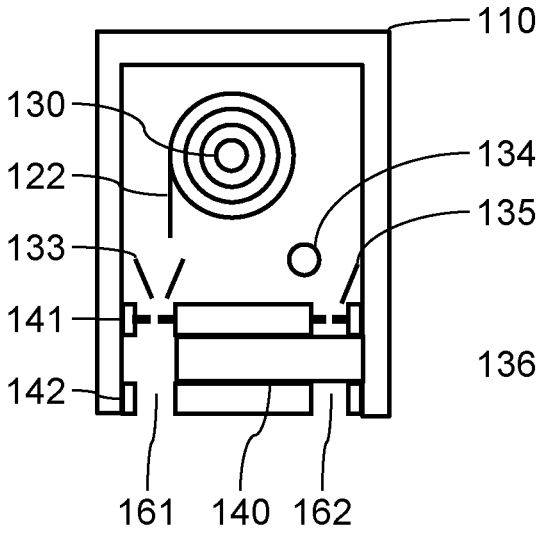
FIG. 16 is an enlarged view in section of the interior in a housing of the roller shutter according to one variant.

The view in section of the interior of the housing 110 of FIG. 16 shows a roller shutter variant. This roller shutter 100 has, overall, the same features as the roller shutter shown in FIG. 4. In this variant, the shutter 140 is wider in order to improve the thermal insulation provided by the housing 110.

Although a command given by a user by means of a remote control has been described, it is also conceivable that the operation of the roller shutter 100 be managed by a home automation system as a function of parameters for optimizing the heat exchanges with the outside.

The invention claimed is:

1. A roller shutter for an opening leaf of a building, wherein said roller shutter comprises a retractable shut-off panel having a structure that moves between a retracted position and a deployed position, a drive device for driving said shut-off panel between said retracted position and a deployed position, a guidance device having a structure that selectively guides said shut-off panel along one of a first path and a second path, wherein said first path is a path between said retracted position and a deployed position in a first plane, and wherein said second path is a path between said retracted position and a deployed position in a second plane parallel to said first plane, said guidance device having a structure that selectively switches movement of said shut-off panel between said first path and said second path, a shaft driven in rotation about an axis by said drive device, said shut-off panel being rolled up around said shaft when in said retracted position, said shaft being driven selectively in one of a direction of rotation for retraction of said shut-off panel and a direction of rotation for deployment of said shut-off panel, said directions of rotation for retraction and deployment being opposite to one another, and a deployment switching stop, wherein said shut-off panel, when in said retracted position, comes into contact alternately with said deployment switching stop when said shaft rotates continuously in said direction of rotation for retraction, wherein said deployment switching stop guides said shut-off panel along said second path when said shut-off panel is in contact with said deployment switching stop and said shaft is driven in said direction of rotation for deployment, and wherein said shut-off panel is guided along said first path when said shut-off panel is not in contact with said deployment switching stop and said shaft is driven in said direction of rotation for deployment.

2. The roller shutter of claim 1, wherein said shut-off panel comprises a face that carries out solar thermal collection.

3. The roller shutter of claim 1, wherein said shut-off panel comprises slats that are articulated to each other about axes parallel to said axis of said shaft, said slats being connected to each other with travel and creating openings therebetween when separated and to shut off said openings when brought close together.

4. The roller shutter of claim 1, wherein said drive device comprises a geared motor to drive said shut-off panel selectively toward said retracted position or toward said deployed position, and a control circuit for controlling said geared motor, said control circuit comprising a control interface accessible to a user for receiving, from said user, a command to one of retract and deploy said shut-off panel.

5. The roller shutter of claim 1, wherein said deployment switching stop is arranged vertically below said shut-off panel when said shut-off panel is rolled up in said retracted position and wherein said deployment switching stop is offset laterally relative to said axis of said shaft.

6. The roller shutter of claim 5, wherein said shut-off panel is drawn by gravity toward contact with said deployment switching stop.

7. The roller shutter of claim 1, further comprising a housing in which said shut-off panel is housed in said retracted position and from which said shut-off panel projects in said deployed positions, said housing comprising first and second openings to allow said shut-off panel to move respectively along said first and second paths, and an isolation device shutting off said first opening when said shut-off panel is moved along said second path and shutting off said second opening when said shut-off panel is moved along said first path.

8. The roller shutter of claim 7, further comprising a brushing device housed in said housing and rubbing against said shut-off panel when said shut-off panel is moved along one of said first and second paths.

9. The roller shutter of claim 7, further comprising slide rails arranged vertically below said housing, wherein said slide rails have a structure that guides said shut-off panel respectively along said first and second paths.

10. The roller shutter of claim 7, wherein said shut-off panel is entirely retracted inside said housing when said shut-off panel is in said retracted position.

11. An opening leaf of a building, said opening leaf comprising a roller shutter as recited in 1, further comprising glazing arranged between said first and second planes.

12. The opening leaf of claim 11, wherein said deployment switching stop is housed in a housing from which one end of said shut-off panel projects when said shut-off panel is in said retracted position, and wherein a command to switch from said first path to said second path causes a preparatory rotation of said shaft in a direction of rotation for retraction of said shut-off panel by said shaft, said preparatory rotation lasting until an end of said shut-off panel contacts said deployment switching stop, followed thereafter by a rotation of said shaft in said direction of rotation for deployment of said shut-off panel.

13. The opening leaf of claim 11, further comprising a lower opening that connects a space between said glazing and said shut-off panel with a space behind said shut-off panel when said shut-off panel is in said deployed position in said second plane, and an upper opening that connects said space between said glazing and said shut-off panel with a space behind said shut-off panel when said shut-off panel is in said deployed position in said second plane.

14. The opening leaf of claim 13, wherein said shut-off panel comprises slats that are articulated to each other about axes parallel to said axis of said shaft, said slats being connected to each other with travel to create openings therebetween when separated and to shut off said openings when brought close together, said roller shutter further comprising an end-of-travel stop below which said lower opening is made, wherein said control circuit interrupts travel of said shut-off panel in said second plane when one end of said shut-off panel comes into contact with said end-of-travel stop and when said slats are still separated in an upper portion of said shut-off panel so as to form an upper opening.

15. A method for controlling a roller shutter of an opening leaf of a building, said method comprising moving a retractable shut-off panel by driving a shaft to cause rotation in a direction of rotation for retraction from a deployed position in a first plane into a retracted position in which said shut-off panel is rolled up around said shaft by having been guided along a first path, rotating said shaft in said direction of rotation for retraction until said shut-off panel is brought into contact with a deployment switching stop, and when said shut-off panel is in continuous contact with said deployment switching stop, moving said shut-off panel by driving said shaft to cause rotation in a direction of rotation for deployment that is opposite to said direction of rotation for retraction, thereby causing said shut-off panel to transition from said retracted position to a deployed position in a second plane parallel to said first plane by guiding said shut-off panel along a second path.

* * * * *